US005341738A

United States Patent [19]

Emrich et al.

[11] Patent Number: 5,341,738

[45] Date of Patent: Aug. 30, 1994

[54] DEVICE FOR TRANSPORTING SHEETS WITHIN A PRINTING MACHINE

[75] Inventors: Helmut Emrich, Offenbach am Main; Reinhold Guba, Darmstadt, both of Fed. Rep. of Germany

[73] Assignee: MAN Roland Druckmaschinen AG, Fed. Rep. of Germany

[21] Appl. No.: 55,225

[22] Filed: Apr. 28, 1993

[30] Foreign Application Priority Data

May 8, 1992 [DE] Fed. Rep. of Germany ..... 4214604

[51] Int. Cl.[5] ..... B41F 13/24

[52] U.S. Cl. ..... 101/232; 101/409

[58] Field of Search ..... 101/232, 409, 408, 410, 101/411, 412; 271/277, 205

[56] References Cited

U.S. PATENT DOCUMENTS

| | | | |
|---|---|---|---|
| 1,597,941 | 8/1926 | White | 101/409 |
| 1,997,290 | 3/1934 | Barber | 101/408 |
| 1,999,587 | 4/1935 | Davis | 271/205 |
| 2,940,387 | 6/1960 | Pritchard | 101/232 |
| 3,662,496 | 5/1972 | Altenstaedter | 51/7 |
| 4,443,094 | 4/1984 | Ricciardi | 101/411 |
| 5,150,652 | 9/1992 | Yamamoto et al. | 101/132 |

*Primary Examiner*—Edgar S. Burr
*Assistant Examiner*—Anthony H. Nguyen
*Attorney, Agent, or Firm*—Leydig, Voit & Mayer, Ltd.

[57] ABSTRACT

A device for transporting sheets within a printing machine in which the sheets are conveyed by gripper carriages which are articulated on endless chains driven by chain wheels. A transfer of the sheets between the gripper carriages and a sheet-guiding cylinder takes place in the region of the chain wheels. The chain wheels, around which the chains are guided do not have a continuous shaft, but are attached to the opposing ends of short stub shafts which are mounted rotatably in the frame side walls of the printing machine. Attached to the other ends of the stub shafts stubs are gear wheels which mesh with gear wheels attached to the two journals of the sheet-guiding cylinder in order to synchronize the chain wheels with the sheet-guiding cylinder. A feed and take-off transport device of this type operates in such a way that a freshly printed sheet or a sheet provided with varnish coating can be transferred to and/or removed from the sheet-guiding cylinder in a smear-free manner.

5 Claims, 1 Drawing Sheet

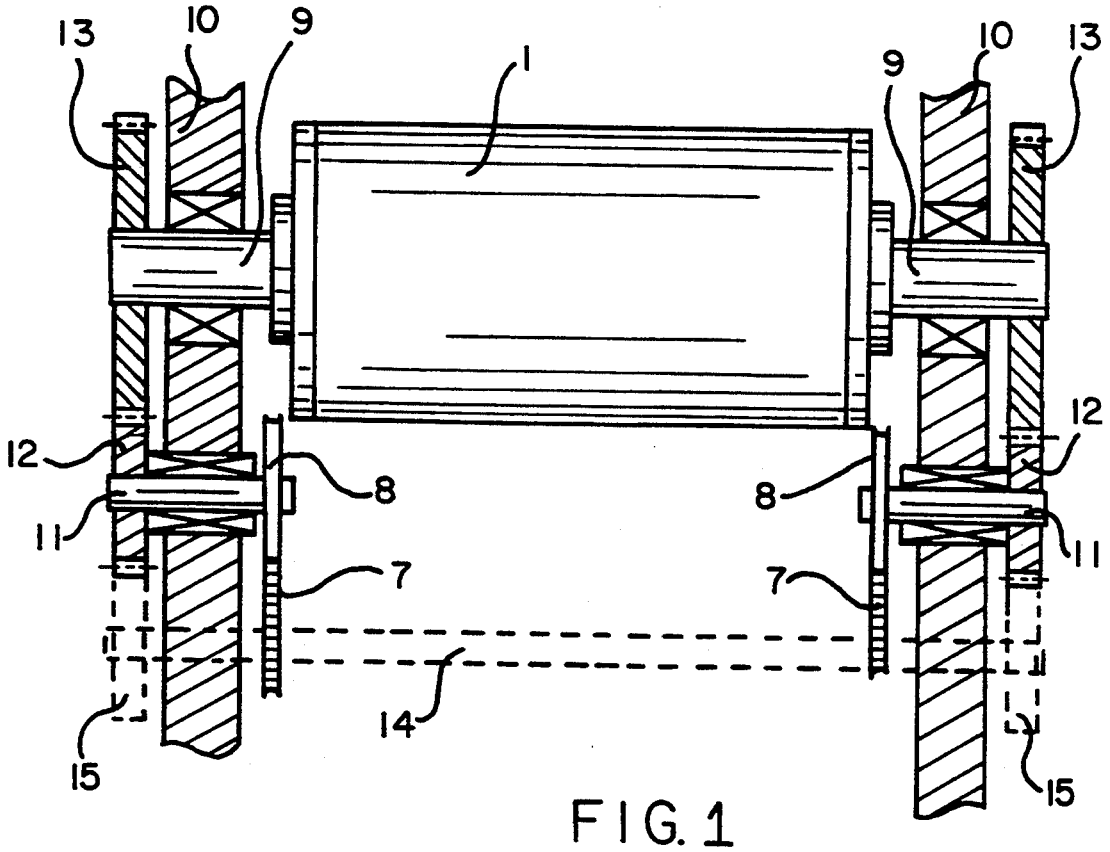
FIG. 1
FIG. 2
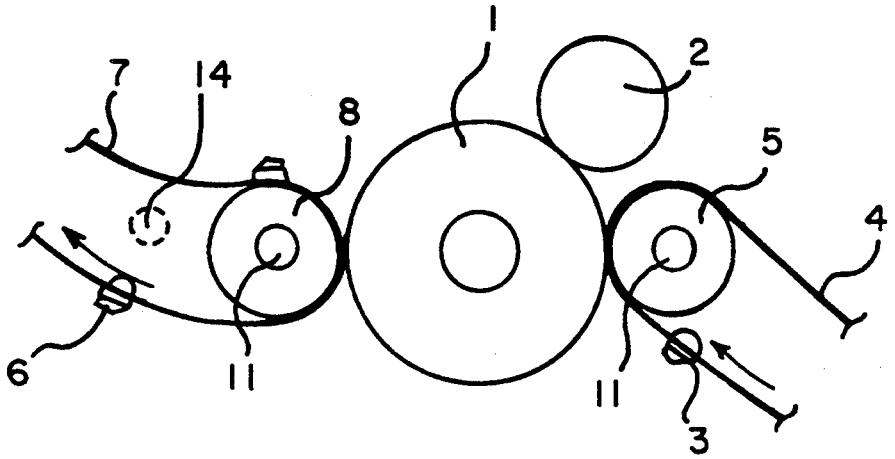

DEVICE FOR TRANSPORTING SHEETS WITHIN A PRINTING MACHINE

BACKGROUND OF THE INVENTION

This invention relates to a device for transporting sheets within a printing machine.

It is known in the art of sheet-fed printing machines to transport the sheets by means of grippers attached to gripper carriages, the gripper carriages being articulated on a pair of endless chains driven by chain wheels. The gripper carriages transport the sheets between the various components of the printing machine. A transport of this kind thus can take place between the individual printing units and, in particular, between the last printing unit and the sheet depository of a delivery stack. It is also known to transport the sheets from the last printing unit to a varnishing unit (with or without a verso-printing unit) and then from the varnishing unit to the sheet depository of the delivery stack. The chain wheels are mounted on a common continuous shaft which is driven from the sheet-guiding cylinder by means of a pair of gear wheels.

In the devices briefly described above, a transfer of the sheets between the gripper carriage and a sheet-guiding cylinder (for example, the impression cylinder of a printing unit or of a varnishing unit), takes place respectively in the region of the chain wheels. After the transfer of a sheet to a gripper carriage, a more or less pronounced curvature of the sheet takes place about the side which was last printed or varnished. Since the aim increasingly is first to print out the sheet completely—or provide it with a varnish coating—and only then transfer it to a gripper carriage, the sheet sometimes undergoes a very considerable looping around the take-off drum on which the chain wheels are mounted. A smearing of the freshly printed or varnished sheet can thus occur on parts of this drum.

The prior art discloses a plurality of feed and take-off drums which carry special devices on their outer circumferences in order to prevent smearing. By way of example, the sheet-guiding drum disclosed in German Patent Specification No. DE 3,930,747 C2 has a plurality of small round brushes arranged in close angularly spaced relation on its outer circumference over the width of the maximum sheet format. The sheet is said to be capable of being supported in a smear-free manner on the bristles of the round brushes. U.S. Pat. No. 3,054,348 discloses brush rings arranged on the drum axle instead of angularly spaced round brushes. Instead of brushes or brush rings, Great Britain Patent Specification No. 972,487 has proposed a number of supporting rollers which are arranged on bars and on which the sheet is likewise to be supported in a smear-free manner. The supporting rollers are adjustable by axial displacement to ink-free locations of the printing images. A particular disadvantage of this is that locations free of printing images are not always present and, in addition, a time-consuming adjustment of the supporting rollers is necessary.

A disadvantage of these previously known devices is that, in general, a smear-free sheet guidance is not always achieved in spite of the sometimes relatively high cost of construction.

The use of so-called air-cushion drums, which are known, for example, from German Patent Specification No. 1,561,043 and from German Patent Specification No. DE 3,827,071 C2, has in practice, afforded very good results with regard to smear-free sheet guidance. In small-format printing machines, however, these devices cannot be used for economic reasons in view of their comparatively high cost.

SUMMARY OF THE INVENTION

The general object of the present invention is, therefore, to improve a device of the above general type in such a way that a smear-free transfer is possible with a relatively low-cost construction.

According to the invention, the region between the chain wheels which drive the endless chains is not designed in the conventional way of a so-called feed and take-off drum and, in particular, there is no continuous shaft on which the sheet can be smeared and particularly when guided in a very sharp S-shaped manner.

Instead of a drum body between the chain wheels, having any smear-free material on its outer circumference or other devices which purportedly allow the sheet to be carried in a smear-free manner, smearing cannot occur at all with the construction of the present invention because a continuous shaft between the common chain wheels is eliminated.

The two chain wheels, around which the two chains together with the gripper carriages are guided in the region of the transfer of the sheets to and from a sheet-guiding cylinder, are mounted on stub shafts on the side walls of the printing machine. Each stub shaft carries outside of the side wall of the printing machine, a gear wheel which meshes, for example, with a gear wheel connected to the sheet-guiding cylinder. The reference diameters of the two pairs of gear wheels are matched to the necessary circumferential speed of the gripper carriages during the sheet take-over/sheet transfer. The synchronization of the rotational movement of the two chain wheels thus takes place by means of gear wheels which are mounted on the two sides of the sheet-guiding cylinder.

As an alternative to mounting gear wheels on both sides of the sheet-guiding cylinder, there can be provided an additional shaft which extends between the side walls of the printing machine and which carries at its ends a pair of gear wheels meshing with the gear wheels of the stub shafts of the chain wheels. The shaft extending between the side walls can be arranged in such a way that the sheets cannot be smeared on the shaft.

The device according to the invention can serve not only as replacement for a conventional take-off drum, by which a printed sheet is conveyed from an impression cylinder to the delivery stack, but of course as replacement for the conventional feed drum, for example for feeding sheets to a varnishing unit. If special measures for a play-free synchronization of the rotational movements of the two chain wheels (play-free intermeshing of the gear wheels) are provided, the device according to the invention can also be used as a corresponding feed and take-off drum in gripper-carriage systems of the type which transport the sheets between the individual printing units in printing machines, for example, of the five-cylinder type. Additional devices such as catching forks or the like are then also located on the chain wheels in order to guide the gripper carriages in register during the sheet take-over.

These and other objects and advantages of the invention will become more apparent from the following detailed description when taken in conjunction with the accompanying drawings.

BRIEF DESCRIPTION OF THE DRAWINGS

FIG. 1 is a top view of a device according to the invention.

FIG. 2 is a schematic elevational view of a varnishing unit with a sheet-feed and sheet-discharge according to the invention.

DETAILED DESCRIPTION OF THE PREFERRED EMBODIMENT

The drawings show a sheet-guiding cylinder 1 which may, for example, be the impression cylinder of a varnishing unit or of a printing unit. The sheet-guiding cylinder 1 has a double-sized diameter and cooperates with a rubber-blanket cylinder 2 which is, for example, the forme cylinder of the varnishing unit.

The sheets to be varnished in the varnishing unit, which has been shown only diagrammatically, are fed to the sheet-guiding cylinder 1 via gripper carriages 3 which are articulated on rotating endless chains 4. The chains 4 are guided around a pair of chain wheels 5 which also serve to drive the chains 4. The transfer of a sheet from the gripper carriage 3 to the sheet-guiding cylinder 1 (the latter has a number of gripper systems according to its diameter) therefore takes place in the region of the chain wheels 5. The sheet being transferred to the sheet-guiding cylinder 1 thus acquires an imprint or varnish coating by means of the rubber-blanket cylinder 2. After complete printing or after complete varnish coating, the sheet is transferred once again to a gripper carriage 6 which is likewise articulated between two rotating endless chains 7 driven via chain wheels 8. As is known in the art, the pair of chain wheels 5 thus acts as a feed drum and the pair of chain wheels 8 acts as a take-off drum. The chains 4, 7 and/or the gripper carriages 3, 6 are guided in a known way by guides (not shown) fixed to the frame.

FIG. 1 is a top view of the region of the sheet take-off according to FIG. 2. The sheet-guiding cylinder 1 is mounted by means of journals 9 in each of the two frame side walls 10 of the printing machine. The chain wheels 8, around which the two chains 7 run in the region of the sheet take-off, are respectively mounted on a pair of mutually aligned stub shafts 11 which also are mounted rotatably in the frame side walls 10. Attached to each stub shaft 11 at the other end thereof is a gear wheel 12 which, according to this exemplary embodiment of the invention, meshes with a gear wheel 13 attached to the respective journal 9 of the sheet-guiding cylinder 1.

The synchronization of the rotational movement of the two chain wheels 8 thus takes place via the two pairs of gear wheels 12, 13 from the two sides of the sheet-guiding cylinder 1. It will be realized that the gear wheels 12, 13 are, of course, in a diametral ratio such that, during the sheet transfer and/or the sheet take-over, the gripper carriages 3, 6 have the same circumferential speed as the gripper system of the sheet-guiding cylinder 1.

A synchronization of the rotational movement of the chain wheels 5, 8 can also take place by means of a separate shaft 14 instead of via the two gear wheels 13 attached to the two journals 9 of the sheet-carrying cylinder 1. The shaft 14 is indicated by broken lines in FIG. 1 and extends between the two frame side walls 10 of the printing machine. The shaft 14 is mounted rotatably in the frame side walls 10 and has, at its two ends, gear wheels 15 (likewise represented by broken lines) which mesh with the gear wheels 12 of the stub shafts 11. In this case, therefore, the synchronization of the rotational movement of the pair of chain wheels 8 takes place via the shaft 14 and the pairs of gear wheels 12, 15. The sheet-guiding cylinder 1 then requires only one journal 9 to have a gear wheel 13 which meshes with a gear wheel 12 of a chain wheel. A possible location for the shaft 14 is represented by broken lines in FIG. 2.

According to the invention, the distance between the opposing ends of the stub shafts 11 is greater than the width of the largest sheet to be processed in the printing machine. A sheet taken off from the sheet-guiding cylinder 1 via the gripper carriage 6 therefore cannot be smeared on any part between the chain wheels 8 in spite of a sharp S-shaped movement of the sheet (see FIG. 2).

In the exemplary embodiment described above, the chain wheels have the same diameter as the rubber-blanket cylinder 2 or the forme cylinder defining the maximum printing format. It will be appreciated that the device according to the invention may also be used as a replacement for double-diameter or multiple-diameter feed or take-off drums.

We claim:

1. A device for transporting sheets within a printing machine having frame side walls and having a rotatable sheet-guiding cylinder located between and supported by said side walls, said device comprising a pair of chain wheels, endless chains driven by said wheels, and gripper carriages mounted on said endless chains for conveying said sheets and for transferring said sheets between said endless chains and said sheet-guiding cylinder in the region of said chain wheels, said device being characterized in that two mutually aligned stub shafts are supported by said frame side walls and have axially spaced facing end portions and opposite end portions extending out from said axially spaced facing end portions, said chain wheels being mounted on said axially spaced facing end portions of said stub shafts such that said gripper carriages grip opposite edges of said sheets to avoid smearing said sheets between said chain wheels, gear wheels mounted on said opposite end portions of said stub shafts, and means meshing with said gear wheels and causing said gear wheels and said chain wheels to rotate in synchronism with said sheet-guiding cylinder.

2. A device according to claim 1 in which said axially spaced facing end portions of said stub shafts are spaced by a distance which is greater than the width of the widest sheet transported by said device.

3. A device according to claim 1 in which said sheet-guiding cylinder includes a pair of oppositely extending journals, said means comprising gear wheels attached to and rotatable with said journals and meshing with said gear wheels on said stub shafts.

4. A device according to claim 1 further including a shaft extending between and rotatably supported by said frame side walls, said means comprising gear wheels rotatable with said shaft and meshing with said gear wheels on said stub shafts.

5. A device according to claim 4 in which said sheet-guiding cylinder includes a pair of oppositely extending journals, said means further comprising a single gear wheel attached to and rotatable with only one of said journals and meshing with said gear wheel on one of said stub shafts.

* * * * *